US007066570B1

(12) United States Patent
van Doorn et al.

(10) Patent No.: US 7,066,570 B1
(45) Date of Patent: Jun. 27, 2006

(54) METHOD OF PRINTING A SUBSTRATE AND A PRINTING DEVICE SUITABLE FOR USE OF THE METHOD

(75) Inventors: Andre van Doorn, Helmond (NL); Eduard Theodorus Hendricus de Grijs, Venlo (NL); Clemens Theodorus Weijkamp, Zijtaart (NL); Jacob Albert Westdijk, Venlo (NL)

(73) Assignee: Oce-Technologies B.V., Venlo (NL)

( * ) Notice: Subject to any disclaimer, the term of this patent is extended or adjusted under 35 U.S.C. 154(b) by 144 days.

(21) Appl. No.: 09/635,798

(22) Filed: Aug. 11, 2000

(30) Foreign Application Priority Data

Aug. 12, 1999 (NL) ..... 1012816

(51) Int. Cl.
*B41J 2/15* (2006.01)
*B41J 2/145* (2006.01)

(52) U.S. Cl. ..... 347/40; 347/41

(58) Field of Classification Search ..... 347/40, 347/9, 12, 16, 41
See application file for complete search history.

(56) References Cited

U.S. PATENT DOCUMENTS 4,528,576 A 7/1985 Koumura et al. ..... 347/15
4,963,882 A * 10/1990 Hickman ..... 347/43
5,568,168 A * 10/1996 Watanabe ..... 347/43
5,640,183 A 6/1997 Hackleman ..... 347/40

FOREIGN PATENT DOCUMENTS

| | | | |
|---|---|---|---|
| EP | 0517521 | 12/1992 | |
| EP | 0622211 | 11/1994 | |
| EP | 0783973 | 7/1997 | |
| EP | 0917955 | 5/1999 | |
| EP | 0925950 | 6/1999 | |
| JP | 60-104335 | * 6/1985 | ..... 347/44 |

OTHER PUBLICATIONS

Patent Abstracts of Japan vol. 1995, No. 01, Feb. 28, 1995, publication No. 06277951, publication date Oct. 4, 1994.

* cited by examiner

*Primary Examiner*—Thinh Nguyen
(74) *Attorney, Agent, or Firm*—Birch, Stewart, Kolasch & Birch, LLP

(57) ABSTRACT

A method of printing a substrate with ink drops, image-wise, utilizing an inkjet printing device containing at least one print head provided with at least one row of nozzles, the substrate forming a regular field of pixel rows and pixel columns, the resolution of the pixel columns being equal to the resolution of the row of nozzles, wherein a first printing stage is initiated in which a strip of pixel rows is provided with ink drops, whereafter the print head is displaced in a direction substantially parallel to the pixel columns, and a second printing stage is initiated in which the strip is provided with supplementary ink drops, wherein the print head is displaced over a distance such that the same is substantially equal to the width of one pixel row.

6 Claims, 9 Drawing Sheets

METHOD OF PRINTING A SUBSTRATE AND A PRINTING DEVICE SUITABLE FOR USE OF THE METHOD

BACKGROUND OF THE INVENTION

The present invention relates to a method of printing a substrate with an inkjet printing device comprising at least one print head provided with at least one row of nozzles, wherein substantially fixed locations on the substrate, which locations form a regular field of pixel rows and pixel columns, are provided with ink drops image-wise, the resolution of the pixel columns being equal to the resolution of the row of nozzles. The method comprises a first printing stage in which a strip of pixel rows is provided with ink drops, whereafter the print head is displaced in a direction substantially parallel to the pixel columns, and a second printing stage in which the strip is provided with supplementary ink drops. The present invention also relates to a printing device suitable for the use of this method.

A method of this kind is known from U.S. Pat. No. 5,640,183. A known problem in inkjet printing devices is that deviations of individual nozzles result in ink drops leaving such nozzles at the wrong angle, so that the ink drops occupy a different place on the substrate with respect to the center (the normal position) of the fixed locations ("pixels"). As a result, disturbing faults can occur in a printed image. This method is based on a redundancy strategy in order to mask such printing faults. In this method, a strip of pixel rows of the substrate is printed in two stages with a print head with which the resolution of the row of nozzles, i.e. the number of nozzles per unit of length, is equal to the resolution of the pixel columns, i.e. the number of locations per unit of length in a direction parallel to the columns. In each stage, a number of locations of the pixel rows of the strip are printed with ink drops such that all the ink drops together form the image for printing within the strip. The known strategy now is such that the row of nozzles comprises a number of extra nozzles, typically six out of a total of 106 nozzles. In the first stage, a first set of ink drops is printed with a sub-row of a size of 100 adjoining nozzles, selected from the complete row. In the second stage, a second set of ink drops is printed with a second sub-row, again consisting of 100 adjoining nozzles. The first and second sets of ink drops together form the image for printing (within said strip).

By now selecting the second sub-row at random from the entire row (in this case there are therefore seven options, i.e. the sub-rows starting with the nozzles 1, 2, 3, 4, 5, 6 or 7 and ending with the respective nozzles 100, 101, 102, 103, 104, 105, 106, 107), any printing faults as a result of deviations in the ejection of ink drops are distributed at random as far as possible over the different strips of the substrate, so that they are barely visible, if at all, to the human eye.

A disadvantage of such a method is that a number of nozzles is not used in each stage, so that the maximum productivity of the printing device is smaller than would be possible based on the total number of nozzles. A following more important disadvantage is that the print head must be very accurately displaced, prior to the second printing stage, with respect to the substrate over a distance which, depending on the choice of the second sub-row of adjoining nozzles, varies with the width of 0.1 or a number of pixel rows (rising to 6 in the example described). A shift of this kind is achieved by displacing the paper by means of a motor. These small but very accurate shifts which are selected at random mean that the accuracy of the paper transport must meet stringent requirements.

SUMMARY OF THE INVENTION

Accordingly, an object of the method according to the present invention is to obviate these disadvantages. To this end, a method has been developed in which the print head is displaced over a distance such that the same is substantially equal to the width of one pixel row. In other words, selection of the position occupied by a second (and any following) print head is no longer a random choice but is made with the fixed displacement over a distance equal to the width of one pixel row. It has been found that this gives better masking of any printing fault as a result of a deviation of a nozzle. This method is based on the realization that systematic deviations of the nozzles can be masked more satisfactorily by a systematic distribution of the printing faults due to such deviations, than is possible with a random distribution of said printing faults. The systematic principle associated with these deviations is that each nozzle always ejects ink drops in the same way. In other words, if a specific nozzle results in ink drops being ejected at a deviant angle (so that the ink drops are printed at a place deviating from the normal position of a location), said nozzle will always eject the ink drops at the same deviant angle. The reason for this is not entirely clear, but might be that the angle at which an ink drop is ejected is significantly determined by the shape and direction of each nozzle, which are substantially invariable in time. Due to the presence of this systematic deviation, it is not necessary to distribute any faults in nozzles at random over the substrate. On the contrary, by making use of the systematic deviation of each nozzle it is possible to obtain better masking of printing faults.

One important advantage of the method according to the present invention is that the shift of the print head no longer has to be chosen at random but one fixed shift is adequate. This means that the paper transport does not have to meet such stringent requirements. It is also possible to use the full length of a row of nozzles in printing a strip of the substrate, because no extra nozzles are required to make a random shift possible. The result of the application of the method according to the invention is that ink drops originating from a specific nozzle are not situated next to one another in one pixel row, with the result that any fault is propagated in a complex pixel row. When using the method according to the present invention, a pixel row contains ink drops originating from different nozzles. This way, possible faults do not propagate in a complete row. Depending on the printing strategy used, the ink drops originating from one individual nozzle are, for example, situated in pairs, one beneath the other, distributed over a number of pixel columns. Printing faults due to a deviation of this specific nozzle are thus uniformly distributed over the substrate. IN a preferred embodiment substantially each pixel is printed with one ink drop at most. This method has the significant advantage that the productivity of the printing apparatus is maximum, compared to known methods where each pixel is printed with multiple ink drops, e.g., two ink drops in the "dot-on-dot" (DOD) or "double-dot-always" (DDA) method. Next to that, this way a minimum amount of ink is consumed per unit area of a substrate.

In a further preferred embodiment, one extra nozzle is added to the row of nozzles. A strip of the substrate can then be printed with a sub-row of adjoining nozzles selected from the complete row, which sub-row contains one nozzle less than the complete row. Although there is hardly any loss in productivity in this way, any loss of information in the first and last pixel rows of a substrate is precluded.

It has surprisingly been found that not only each individual nozzle ejects ink drops causing the same printing fault during the life of the print head, but also that corresponding nozzles of different rows or print heads which have been produced in comparable manner, for example in the same jig, significantly eject ink drops resulting in the same printing fault. In other words, nozzle i of a row of nozzles of a specific print head has substantially the same deviation as nozzle i of the corresponding row of each other print head which has been made in the same way. For the use of the method according to the present invention this means that it is not necessary to use in the first and second printing stages the same row of nozzles belonging to the same print head which between the first and second stages is displaced over a distance in the width of one pixel row with respect to the substrate, but that it is possible to use two different rows of nozzles. These may each belong to a separate print head or alternatively be combined in one combined print head. The foregoing can be used by incorporating the fixed shift between the rows in their mutual arrangement in the printing device scanning carriage. The great advantage of this is that the paper transport can be made much simpler because it is no longer necessary to control the small shift over the width of one pixel row via the paper transport. The paper transport need only be limited to relatively large steps, for example, of the length of the print head or, depending on the printing strategy, part of the length of the print head. This means that in a preferred embodiment the row of nozzles used in the first printing stage differs from the row of nozzles used in the second printing stage. In another preferred embodiment, the print head used in the first printing stage differs from the print head used in the second printing stage.

BRIEF DESCRIPTION OF THE DRAWINGS

The present invention will now be explained in detail with reference to the accompanying drawings, wherein.

DETAILED DESCRIPTION OF THE INVENTION

Figure 1:
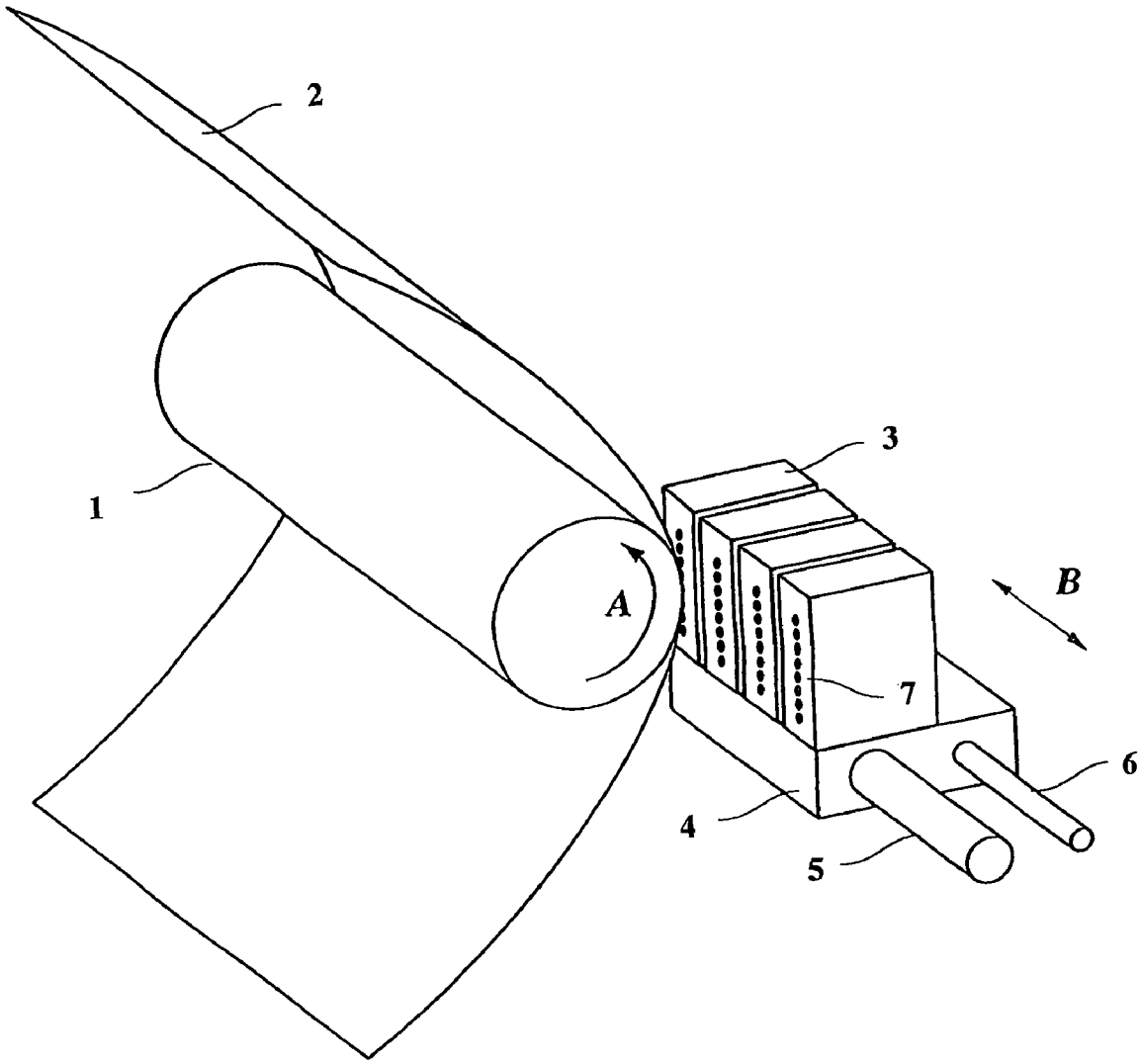
FIG. 1 is an example of a printing device provided with ink ducts.

FIG. 1 shows a printing device provided with ink ducts. In this embodiment, the printing device comprises a roller 1 for supporting a substrate 2 and moving it along four print heads 3. The roller 1 is rotatable about its axis as indicated by arrow A. A scanning carriage 4 carries four print heads 3 and can be moved in reciprocation in the direction indicated by the double arrow B, parallel to roller 1. In this way the print head 3 can scan the receiving medium 2. The carriage 4 is guided on rods 5 and 6 and is driven by suitable means (not shown).

In the embodiment as illustrated in the drawing, each print head 3 comprises eight ink ducts, each with its own nozzle 7, which form a row perpendicular to the axis of roller 1. In a practical embodiment of a printing device, the number of ink ducts per print head 3 will be many times greater. Each ink duct is provided with means for activating the ink duct (not shown) and an associated electrical drive circuit (not shown). In this way, the ink duct, the said means for actuating the ink duct, and the drive circuit form a unit which can be used for ejecting ink drops in the direction of roller 1. If the ink ducts are activated image-wise, an image forms which is built up of ink drops on the substrate 2. When a substrate is printed with a printing device of this kind, in which ink drops are ejected from ink ducts, the substrate or part of said substrate is divided up into a number of fixed locations, which locations form a substantially regular field of pixel rows and pixel columns. Thus an imaginary field forms which is built up from separate locations each of which can be provided with one or more ink drops. In this embodiment, the pixel columns parallel to the rows of nozzles are substantially perpendicular to the pixel rows. The number of locations per unit of length in the directions parallel to the pixel rows and pixel columns is termed the resolution of the printed image, indicated, for example, as 400×600 d.p.i. ("dots per inch"). By activating the ink duct image-wise when the print heads move over a strip of the substrate, as shown in FIG. 1, an image forms on the substrate built up from individual ink drops on such locations.

Figure 2A:
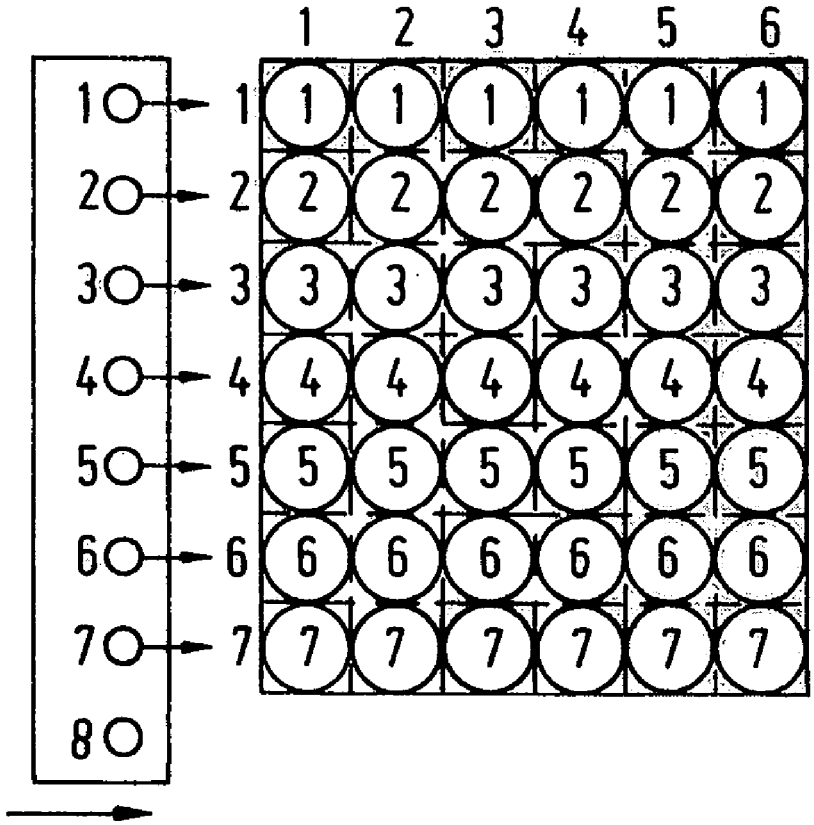
FIG. 2 shows the visible effect of a deviation of a nozzle if no corrective steps are taken.
Figure 2B:
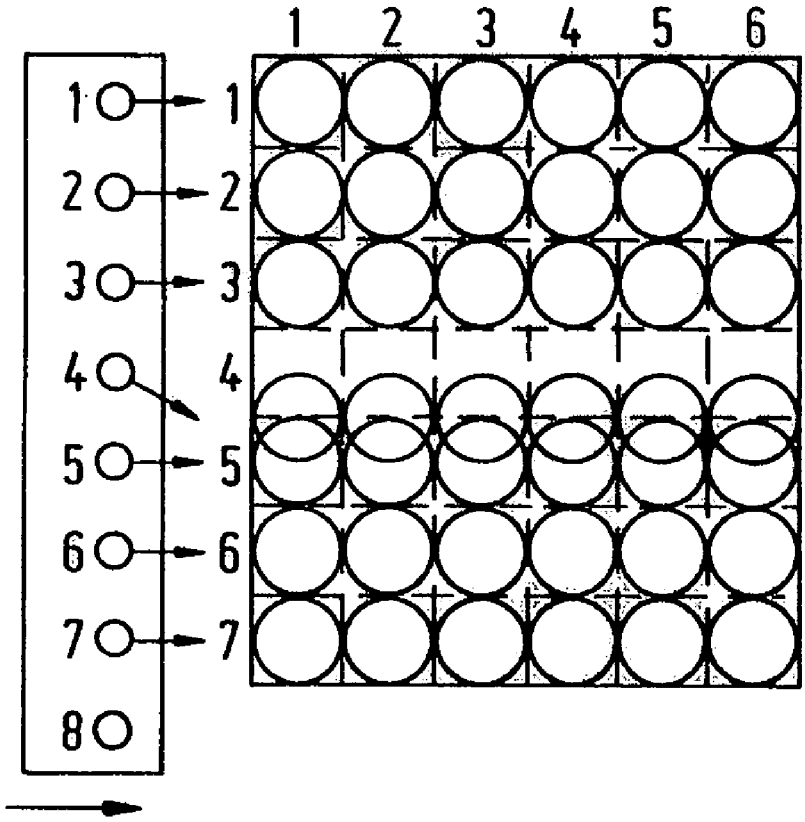

FIGS. 2*a* and 2*b* show the possible visible effect of a deviation of a nozzle if no corrective steps are taken. In this example, use is made of a print head provided with a row of eight nozzles.

FIG. 2*a* shows how it is possible, using this print head, to print part of a substrate in a size of 7 (pixel rows)×6 (pixel columns) locations. If a single-pass printing strategy is selected, then a print head moves only once over the part of the substrate for printing and the entire image is formed in that step. In this example, the image consists of a solid surface. Assume that all the nozzles eject the ink drops correctly (in FIG. 2*a* this is indicated by the small horizontal directional arrows originating from each nozzle). When the print head is moved over the substrate in a direction parallel to the pixel rows, and the nozzles 1–7 are activated image-wise, then the resulting image is as shown in FIG. 2*a*. The originating nozzle for each of the printed ink drops is indicated. Assuming that nozzle 4 has a slight deviation so that ink drops are ejected at an angle deviating from the normal axis, as shown by the small directional arrow at this nozzle in FIG. 2*b*, and that the other nozzles have no deviations, then when the relevant part of the substrate is printed with the same printing strategy the resulting image is as shown in FIG. 2*b*. It will be apparent that a linear fault forms in the image due to the propagation of the fault as a result of the deviant nozzle 4 (so that ink drops are not printed in the center of the locations of pixel row 4). Faults of this kind are readily visible to the human eye and therefore have a very disturbing effect in a printed image.

Figure 3A:
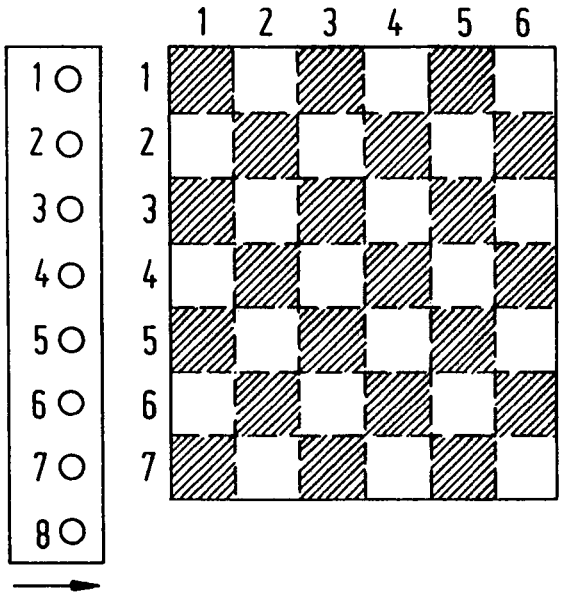
FIG. 3 is an example of the method according to the present invention.
Figure 3B:
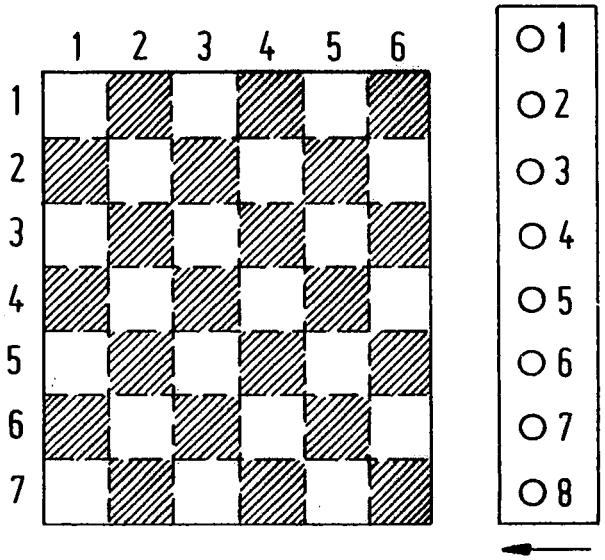
Figure 3C:
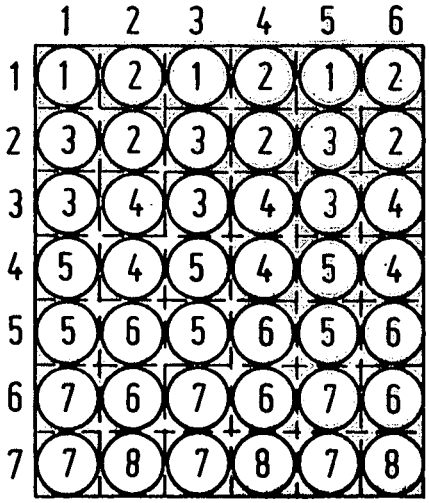

FIG. 3 gives an example of the method of printing a substrate according to the present invention. The printing strategy will be explained by reference to a print head as described in the example of FIGS. 2*a* and 2*b*. Just as in the known method, a substrate is printed in a number of stages, i.e. a "multi-pass" strategy, wherein part of the image formed by using a dilution pattern is printed in each stage. The diluted images printed in each stage complement one another so that on completion of all these stages the total image is formed. In the example described here, we shall, for the sake of simplicity, assume a two-stage strategy, in which the sub-images are printed in accordance with what is known as a chessboard pattern, so that two complementary sub-images have to be printed in two stages. FIG. 3*a* shows what part of the substrate can be printed when the print head moves in the indicated direction over the substrate in the first stage, the nozzles 1–7 corresponding to the pixel rows 1–7. The locations in the first pixel row can be successively provided with an ink drop originating from nozzle 1, the locations in the second pixel row can be successively provided with ink drops originating from nozzle 2, and so on. When the print head has completely passed the substrate, the print head is displaced with respect to the substrate so that the nozzles 2–8 correspond to the pixel rows 1–7. The print head is then moved over the substrate in the opposite direction, during which the complementary sub-image can be printed. If the image in the relevant part of the substrate consists of a solid surface, then the ink drop distribution obtained is as indicated in FIG. 3*c*. Here it will be apparent that ink drops originating from one individual nozzle are no longer situated next to one another in one pixel row, but that they are always beneath one another in pairs. The different "pairs" of ink drops are distributed over different pixel columns.

Figure 4A:
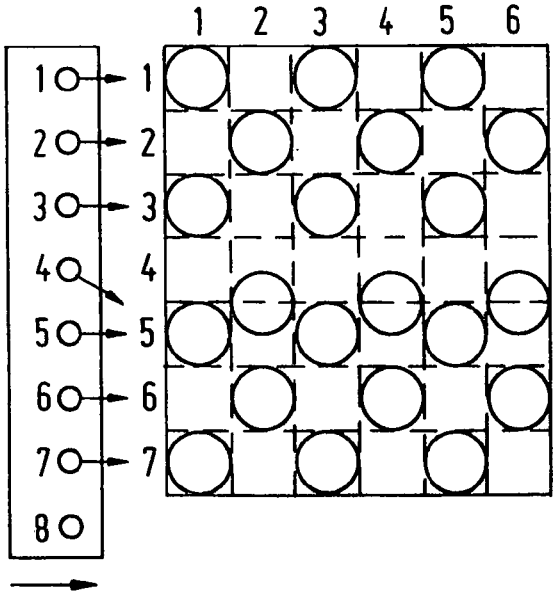
FIG. 4 shows the way in which fault masking occurs using the method according to the present invention.
Figure 4B:
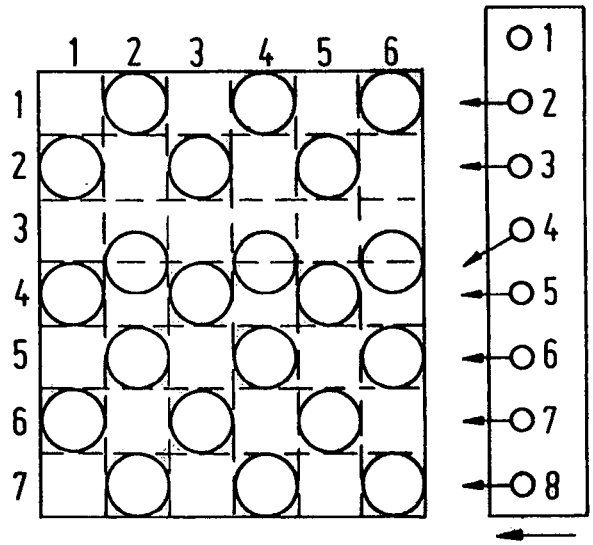
Figure 4C:
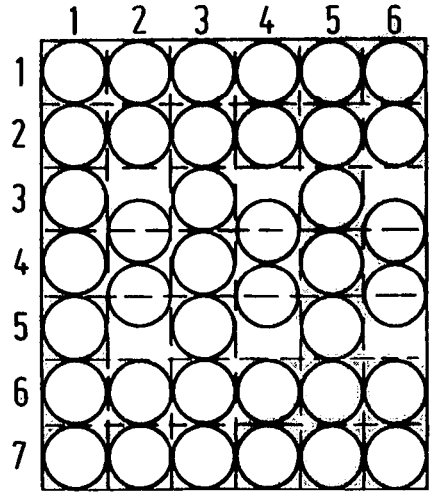

FIGS. 4*a*, 4*b* and 4*c* show the way in which visible effects of nozzle deviations can be masked using the method according to the present invention. The method as described in FIGS. 3*a* and 3*b* is applied in this example to the print head as described in connection with FIG. 2*b*, i.e., a print head having a deviant nozzle 4. In this example the image consists of a solid surface. FIG. 4*a* shows the sub-image forming in the first stage using the chessboard pattern as shown in FIG. 3*a*. FIG. 4*b* shows the sub-image forming in the second stage, the print head being displaced by an amount equivalent to one pixel row. In FIG. 4*c* the two sub-images are combined.

By the use of the method according to the present invention the ink drops with a deviation are no longer situated next to one another in one pixel row as shown in FIG. 2*b*, but are situated in pairs one under the other distributed over the pixel columns 2, 4 and 6. In other words, the linear fault is interrupted in the horizontal direction and the ink drops positioned with the deviation are distributed uniformly over a number of pixel columns. By use of the fact that nozzle 4 always ejects an ink drop at the same deviant angle, a uniform fault distribution can be obtained, i.e. one which is scarcely visible, if at all. For this purpose, the shift for the start of the second printing stage is not chosen at random, but all that is required is a fixed shift, the distance being equal to the width of one pixel row.

FIG. 5 shows another example of use of the method according to the present invention. In this example, in accordance with the examples relating to FIGS. 2, 3 and 4, a print head is used which consists of eight nozzles in order to print a solid surface on a substrate, divided into 7 pixel rows and 6 pixel columns.

Figure 5A:
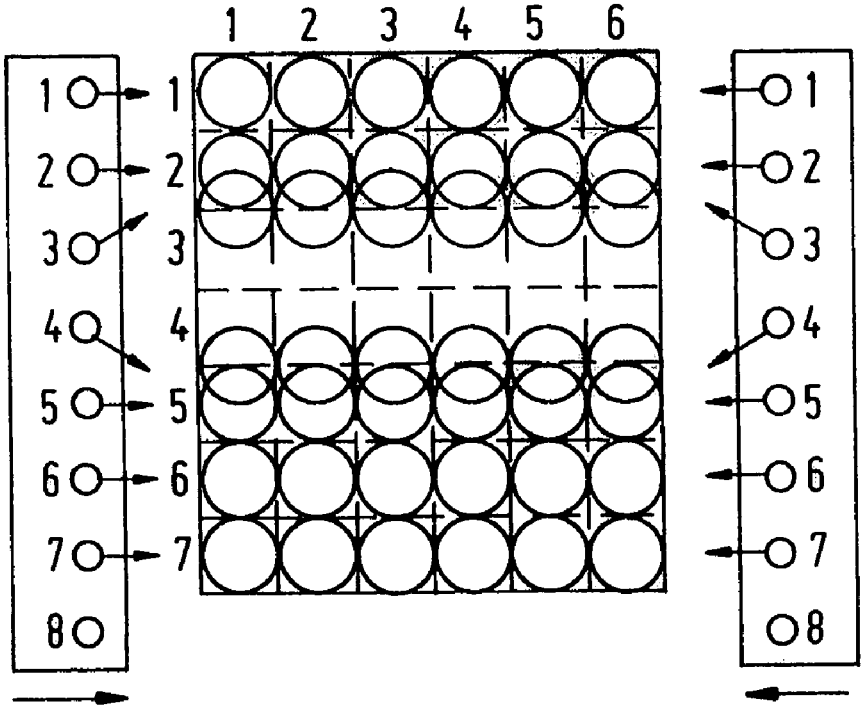
FIG. 5 is an example of an application of the method according to the present invention for a row of nozzles in which a number of nozzles have deviations.

In this print head, nozzle 3 has a deviation in the direction of nozzle 2. In addition, nozzle 4 has a deviation in the direction of nozzle 5. If the substrate is printed with this column in two stages, nozzles 1–7 being used both in the first and second stage, without shifting the print head prior to the second stage, then the resulting image is as shown in FIG. 5*a*. A wide unprinted line results on the substrate.

Figure 5B:
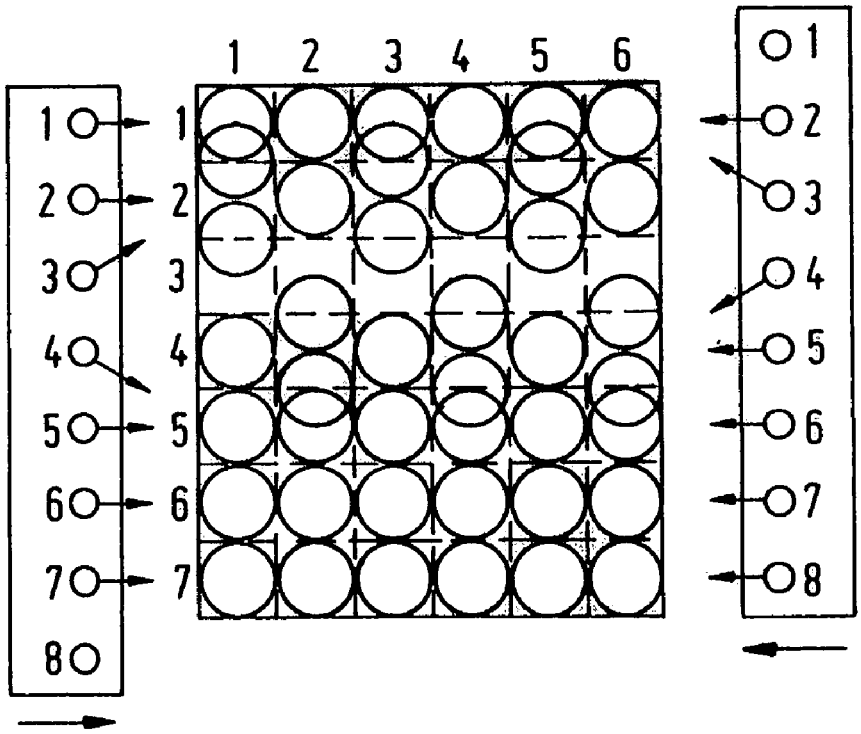

The use of the method according to the present invention as indicated hereinbefore in FIGS. 3 and 4, in which the first set of locations is printed with nozzles 1–7, whereafter the print head is shifted, so that the second set of locations is printed with the nozzles 2–8, results in the image shown in FIG. 5*b*. The wide unprinted line has changed to a less densely printed line, and this is much less disturbing.

FIGS. 6*a*–6*d* show what images can result from printing a solid surface using the method known from U.S. Pat. No. 5,640,183 in order to mask the faults resulting from deviations in nozzles identical to those shown in FIG. 5. In this example, a pair of (correctly functioning) nozzles is added to the row of nozzles of the print head at the start of the column, i.e. nozzles −2 and −1, so that the print head is built up from ten nozzles. In the first stage, just as in the example shown in FIG. 5, a first set of locations is printed with the nozzles 1–7. Another sub-row of seven nozzles is then selected at random from the complete row in order to print the remaining locations in the second stage. In view of the total number of nozzles of the column, there are four possibilities for this, namely the sub-rows starting with nozzles −2, −1, 1 or 2, and ending with the nozzles 5, 6, 7 or 8.

Figure 6A:
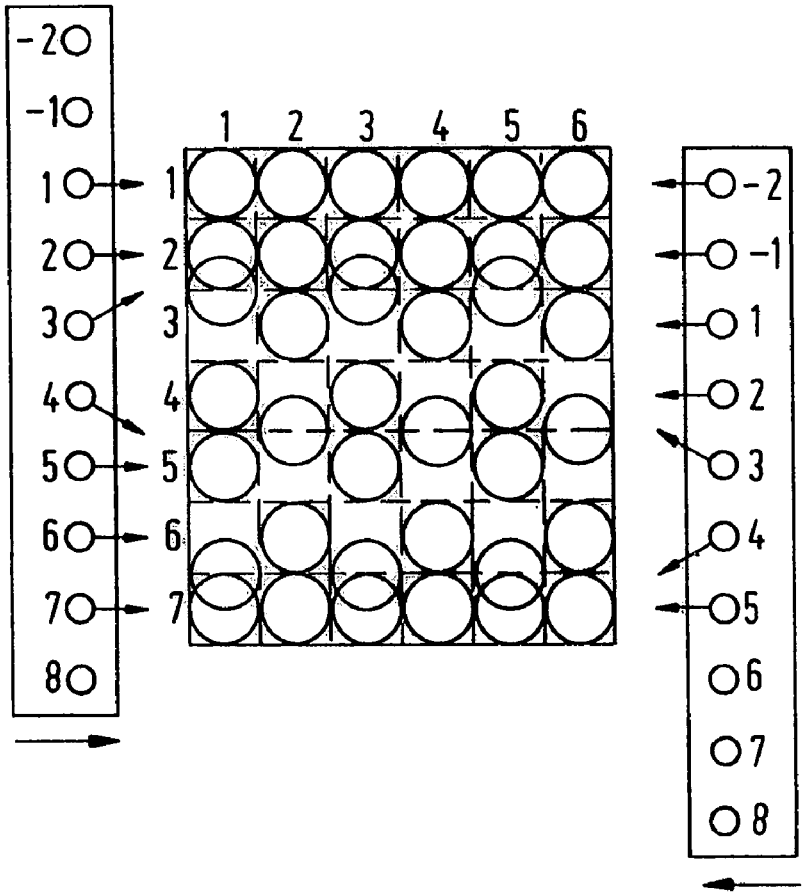
FIG. 6 indicates, for a row of nozzles as shown in FIG. 5, the images that can be formed using the method known from U.S. Pat. No. 5,640,183.

FIG. 6*a* shows the image resulting from printing the second set of locations with the sub-row beginning with nozzle −2. It will be apparent that the image has a more disturbing fault than when the method according to the present invention is used. There are now two less densely printed lines in the image. This is due to the fact that nozzle 3 in the second stage prints on the same (deviant) place as nozzle 4 in the first stage.

Figure 6B:
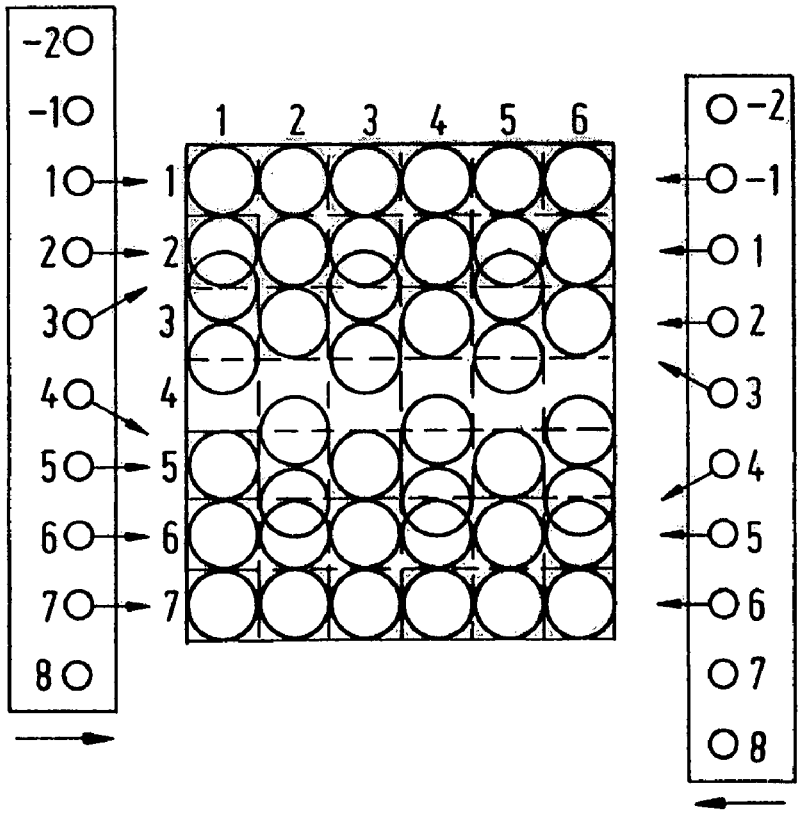

FIG. 6*b* shows the image forming when the second set of locations is printed with the sub-row beginning with nozzle −1. It will be apparent that the image has the same fault as when using the method according to the present invention, i.e., one less densely printed line.

Figure 6C:
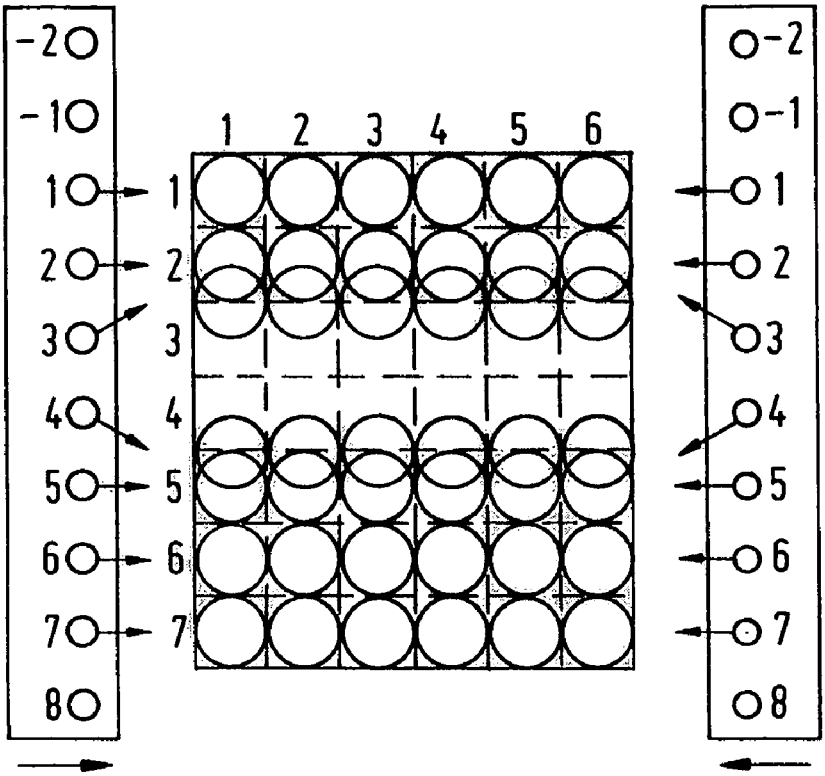
Figure 6D:
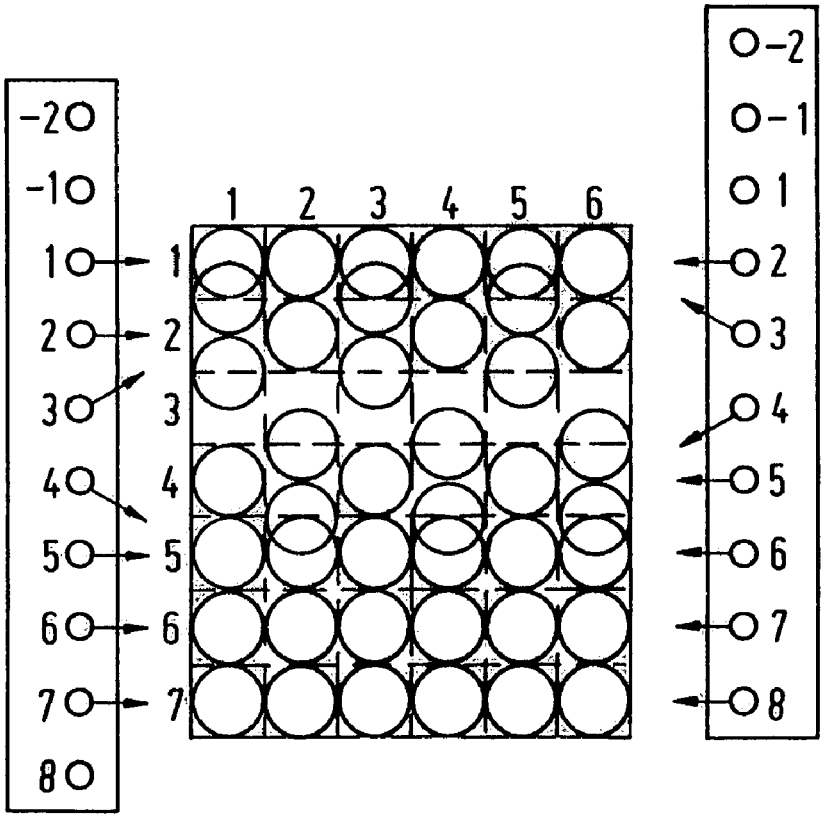

If the second set of locations is printed with the sub-row beginning with nozzle 1, the resulting image is as shown in FIG. 6*c*. This image has a fault greater than when the method according to the present invention is used. If the second set of locations is printed with the sub-row according to the latter possibility, i.e. the sub-row starting with nozzle 2, then the resulting image is as shown in FIG. 6*d*. This image contains the same fault as when the method according to the present invention is used.

It is apparent from these examples that when the known method is used, with the attempt to mask nozzle deviations by distributing them at random over the substrate, the final fault in the image in half of the cases is equal to the fault when the method according to the present invention is used, but in the other half is larger than the fault when the method according to the present invention is used. And this applies irrespective of the fact that two extra properly functioning nozzles are required in the known method and in addition a random choice has to be made for the displacement of the print head between each of the stages.

Figure 7A:
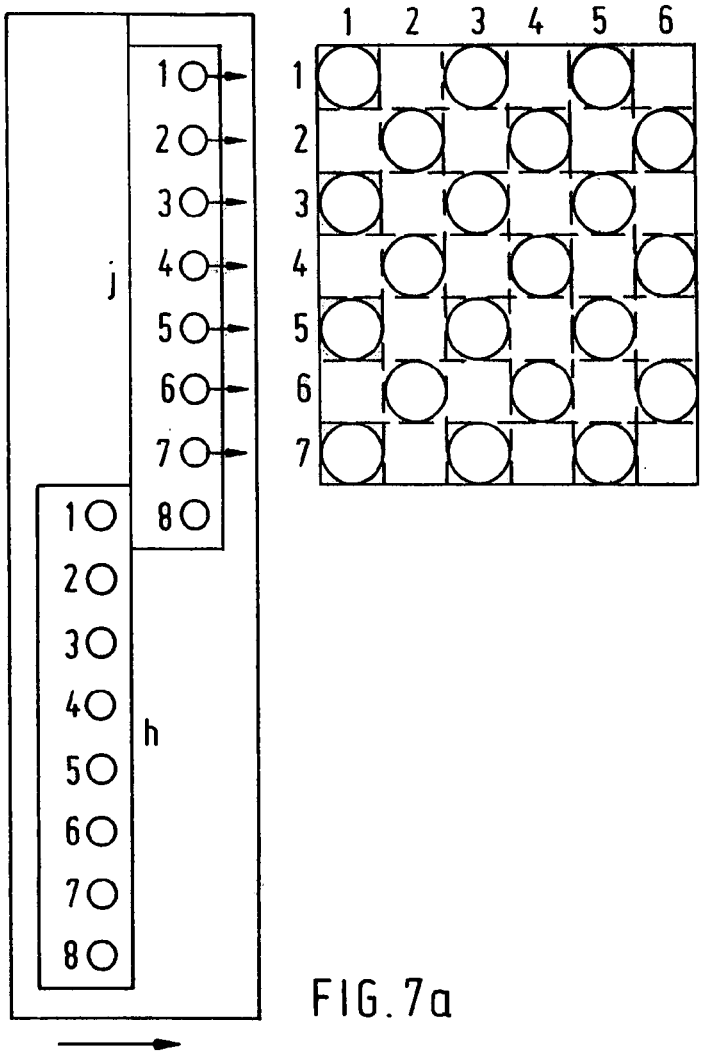
FIG. 7 gives an example of the possible arrangement of two rows of nozzles in a printing device according to the present invention.
Figure 7B:
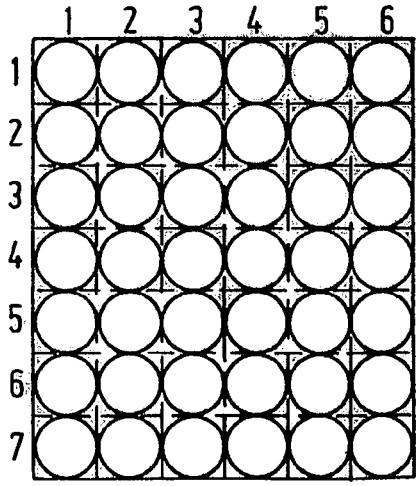
Figure 7B:
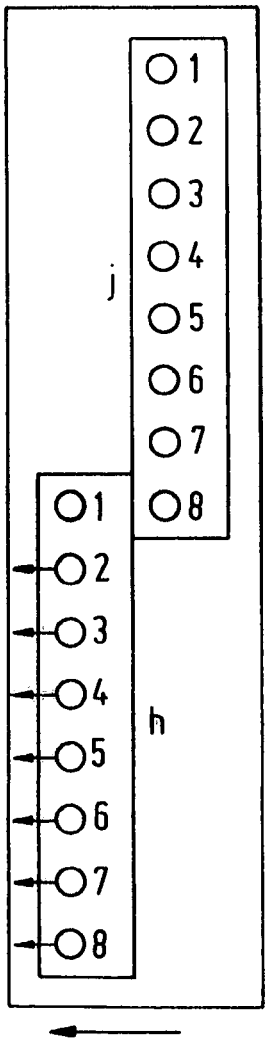

FIG. 7 shows an example of a possible arrangement of two print heads (which have been produced in the same way and therefore, significantly, have the same deviations) in a printing device according to the present invention. Here the print head h is shifted over a distance equal to the length of the row of nozzles minus the distance equal to the width of one pixel row, with respect to the print head j, whereafter this arrangement is fixed (and the two print heads in fact now form one combined print head). With an arrangement of this kind, a first set of locations of the substrate can be provided with ink drops from print head j as indicated in FIG. 7*a*, in a first stage. The substrate is then moved over a distance equal to the length of one row of nozzles, so that the nozzles 2–8 of print head h are situated level with pixel rows 1–7, as shown in FIG. 7*b*, whereafter a second set of locations is printed originating from column h. In this way, the masking of any printing faults is obtained in accordance with the present invention, it being possible to make the paper transport very rugged. The advantage of printing part of the image in two successive stages, inter alia, is that ink drops can dry before a neighbouring drop is printed. In this way it is possible to prevent ink drops from overflowing into one another.

Figure 8:
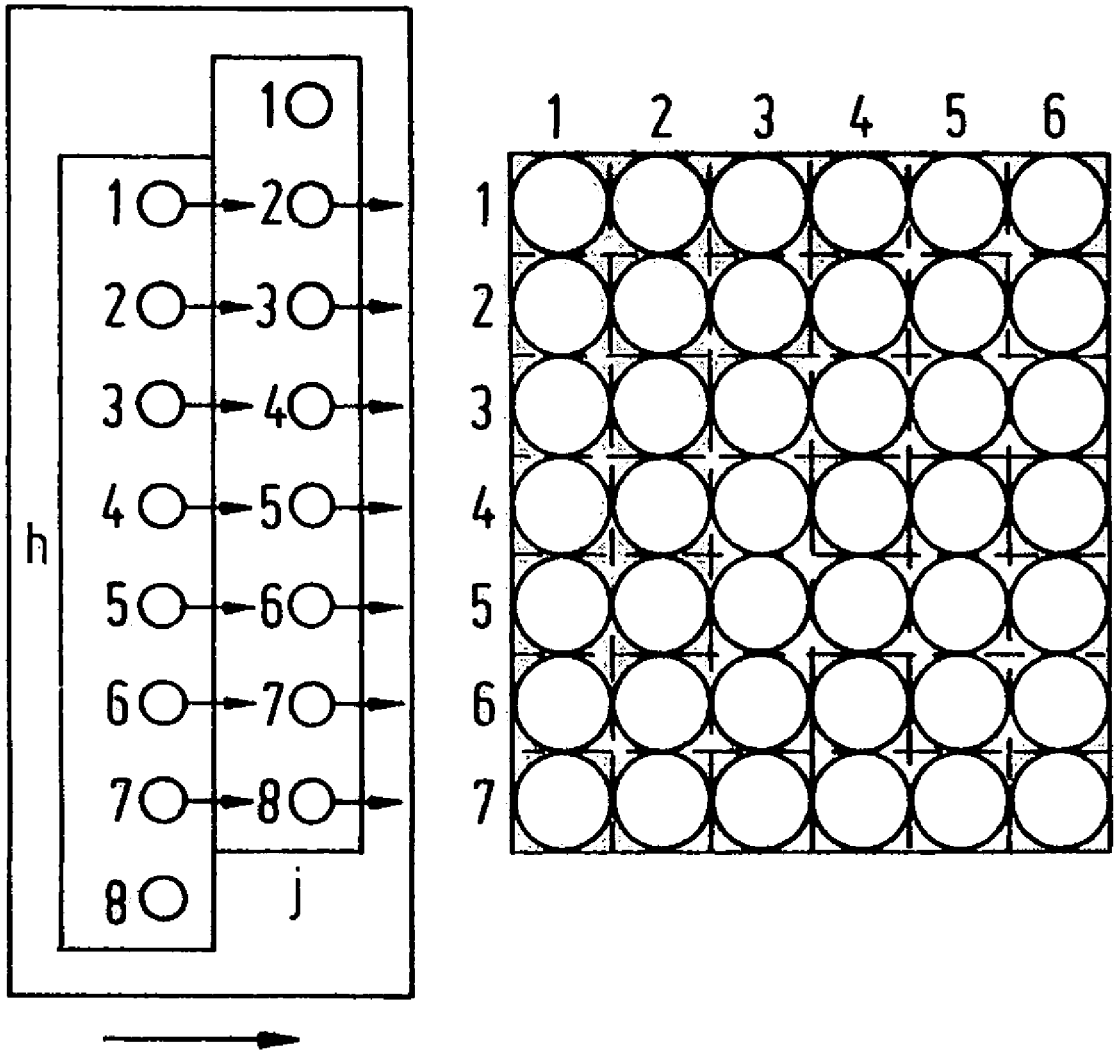
FIG. 8 is another example of the possible arrangement of two rows in a printing device according to the present invention.

FIG. 8 shows a second example of an arrangement of two print heads h and j in a printing device. By selecting an arrangement of this kind, in which print head h is displaced with respect to print head j over a distance equal to the distance corresponding to the width of one pixel row, it is possible to print the entire substrate in one stage over a width substantially equal to the length of the rows of nozzles. The advantage of an arrangement of this kind is that the combined print head is compact. Also, with a combined print head of this kind, a strip of the substrate can be completely printed in one scanning movement of the scanning carriage, even when the image is built up from two complementary sub-images.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of printing a substrate with ink drops, image-wise, utilizing an inkjet printing device containing at least one print head provided with at least one row of nozzles, said substrate forming a regular field of pixel rows and pixel columns, the resolution of the pixel columns being equal to the resolution of the row of nozzles, which comprises initiating a first printing stage in which a strip of pixel rows is provided with ink drops, whereafter the print head is displaced in a direction substantially parallel to the pixel columns, and initiating a second printing stage in which the strip is provided with supplementary ink drops, wherein the print head is displaced over a distance which is not selected from a plurality of distances but which is a fixed distance such that the same is always substantially equal to the width of one pixel row.

2. The method according to claim 1, wherein one extra nozzle is added to the row of nozzles.

3. The method according to claim 1, wherein the row of nozzles used in the first printing stage differs from the row of nozzles used in the second printing stage.

4. The method according to claim 1, wherein the print head used in the first printing stage differs from the print head used in the second printing stage.

5. The method according to claim 1, wherein substantially each pixel is printed with no more than one ink drop.

6. An apparatus for printing a substrate with ink drops, image-wise, which comprises an inkjet printing device containing at least one print head provided with at least one row of nozzles, said substrate forming a regular field of pixel rows and pixel columns, the resolution of the pixel columns being equal to the resolution of the row of nozzles, means for initiating a first printing stage in which a strip of pixel rows is provided with ink drops, said print head being displaced in a direction substantially parallel to the pixel columns, and means for initiating a second printing stage in which the strip is provided with supplementary ink drops, wherein the print head is displaced over a distance which is not selected from a plurality of distances but which is a fixed distance such that the same is always substantially equal to the width of one pixel row.

* * * * *